US006773296B2

(12) United States Patent
Kihira et al.

(10) Patent No.: US 6,773,296 B2
(45) Date of Patent: Aug. 10, 2004

(54) CONNECTOR

(75) Inventors: Souji Kihira, Nagoya (JP); Sho Miyazaki, Nagoya (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 20 days.

(21) Appl. No.: 10/147,891

(22) Filed: May 20, 2002

(65) Prior Publication Data

US 2002/0177351 A1 Nov. 28, 2002

(30) Foreign Application Priority Data

May 23, 2001 (JP) ..... 2001-154206

(51) Int. Cl.[7] ..... H01R 13/56; H01R 13/58

(52) U.S. Cl. ..... 439/445; 439/248; 439/456; 439/596; 174/93; 385/72

(58) Field of Search ..... 439/248, 445, 439/450, 456–458, 596; 174/93, 135; 385/60, 72, 78

(56) References Cited

U.S. PATENT DOCUMENTS 4,034,944 A * 7/1977 Moran ..... 248/56
4,101,187 A * 7/1978 Collier ..... 439/596
4,652,082 A * 3/1987 Warner ..... 385/83
4,838,808 A * 6/1989 Fujiura ..... 439/357
4,842,550 A * 6/1989 Fry, Jr. et al. ..... 439/471
5,710,851 A * 1/1998 Walter et al. ..... 385/86
6,225,557 B1 * 5/2001 Fonteneau et al. ..... 174/50
6,390,687 B1 * 5/2002 Shirakawa ..... 385/86
6,485,194 B1 * 11/2002 Shirakawa ..... 385/78
6,517,361 B1 * 2/2003 Yatskov et al. ..... 439/67

FOREIGN PATENT DOCUMENTS

JP A 5-69868 3/1993
JP U 5-69868 9/1993

* cited by examiner

*Primary Examiner*—Michael C. Zarroli
(74) *Attorney, Agent, or Firm*—Oliff & Berridge, PLC

(57) ABSTRACT

A connector includes, a wire holder having an arcuate outer-surface-side half member to which an outer surface of a bent part of a wire is fitted; an inner-surface-side half member to which an inner surface of the bent part of the wire is fitted; and an unification holder for holding both half members in a united condition. When the outer-surface-side half member and the inner-surface-side half member are held in a state in which the member are united with each other in such a way as to sandwich the wire, the wire is arcuately bent by fitting between both the half members. Thus, the wire can be held in a state in which the wire is bent with a predetermined curvature.

9 Claims, 6 Drawing Sheets

CONNECTOR

BACKGROUND OF THE INVENTION

1. Field of Invention

The present invention relates to a connector having an electric wire cover.

2. Description of Related Art

In the case that a sufficient wiring-arrangement space cannot be secured in the vicinity of an inverter apparatus provided in an engine room of an electric car, wiring arrangement is troublesome. When a connector of a motor circuit, which is extended from a motor for driving wheels, is connected to the inverter apparatus, a wiring arrangement should be performed by bending an electric wire, which is led out from the connector, almost 90 degrees so that the wire extends along an external surface of the inverter apparatus.

However, the wire used in the motor circuit is large in a total diameter of an electric conductor and an insulating coating, and has high flexural rigidity and high restoring force when bend-deformed, as compared with a wire used in a signal circuit. Thus, the conventional wire has problems in that it is difficult to bend the wire in such a way as to have a predetermined curvature, and that the bent condition of the wire cannot be maintained for a long time simply by bending the wire by hands.

There have been techniques disclosed in JP-A-5-69868U as means for bending a wire led out from the rear surface of a connector housing in a transverse direction. That is, the rear surface of a connector housing is covered with a wire cover having a nearly U-shaped section. In the wire cover, pluralities of wires are accommodated in such a way as to extend in a transversal direction. Further, the wires are led out in a transversal direction from an opening provided in a side surface of the wire cover.

However, this wire cover is for wires each having relatively low flexural rigidity. That is, in the wire cover, each of the wires is not guided but bent with a suitable curvature. Thus, inevitably, there is slight variation in the direction, in which the wire is led out from the wire cover, among the wires. Incidentally, in the case that the wire has low flexural rigidity and that the direction, in which the wire is led out from the wire cover, can easily be corrected, the wiring arrangement of the wire along a predetermined path can be achieved. In contrast, in the case of a thick wire to be used in a motor circuit of an electric car, it is difficult to correct the direction, in which the wire is led out from the wire cover. Therefore, it is difficult to perform the wiring arrangement along a predetermined path.

SUMMARY OF THE INVENTION

The invention is created in view of the aforementioned circumstances. Accordingly, an object of the invention is to enable an electric wire to be held in a bent condition even in the case that the wire generates a large restoring force when bend-deformed.

In order to solve the above problems, the present invention provides a connector comprising: a housing, from the rear surface of which a wire is led out; and a wire holder to which the wire led out from the rear surface of the housing is fitted thereby to hold the wire in an arcuately bent state, wherein the wire holder includes: an arcuate outer-surface-side half member to which an outer surface of a bent part of the wire is fitted; an arcuate inner-surface-side half member to which an inner surface of a bent part of the wire is fitted; and a unification holder for holding the outer-surface-side half member and the inner-surface-side half member in a united condition.

When the outer-surface-side half member and the inner-surface-side half member are held in a state in which these half members are united with each other in such a way as to sandwich a wire, the wire is brought into a state in which the wire is arcuately bent by the fitting between the wire and each of both the half members. Both the outer surface and the inner surface of the bent part of the wire are fitted to the arcuate half members, so that the wire can be held in a state in which the wire is bent with a predetermined curvature.

It is preferable that an arcuate reinforcing rib is formed on at least one of an outer surface of an arcuate portion of the outer-surface-side half member and an inner surface of an arcuate portion of the inner-surface-side half member.

When the arcuate reinforcing rib is formed, there is no fear that the outer-surface-side half member or the inner-surface-side half member is deformed in such a way as to change the curvature of the arcuate portion. Consequently, the wire can be reliably held so that the wire has a predetermined curvature.

It is preferable that the unification holder includes: a connecting portion for pivotally connecting the outer-surface-side half member and the inner-surface-side half member to each other at leading end portions thereof; and a fitting hole, provided in the rear surface of the housing, for regulating disengagement between the half members by inner-fitting base end portions of the half members.

After the wire is fitted to one of the outer-surface-side half member and the inner-surface-side half member, the other half member is rotated with respect to the connecting portion, which serves as a fulcrum, until those half members are engaged with each other. Then, the disengagement between both the half members is regulated by inner-fitting the base end portions of the half members into the fitting hole of the housing, while both the half members are caused to slide along the direction of length of the wire. Thus, both the half members are locked in a united condition. When united with each other, both the half members are engaged with each other by using the connecting portion as a fulcrum. Thus, even when the wire is hard and thus difficult to bend, the wire can be reliably held with a small force by inserting the wire into between both the half members and by leverage.

It is preferable that fitting portions are provided on the rear surface of the housing and abase end portion of the wire holder, the fitting portions are fitted to each other so as to regulate a saccadic movement (rattling) of the wire holder with respect to the housing.

When the above structure is adopted, the direction, in which the wire is led but from the rear surface of the housing, is held constant by regulating a rattling of the wire holder with respect to the housing. Thus, in the case that a waterproof cylindrical rubber plug is attached to between the inner periphery of a cavity opened in the rear surface portion of the housing and the outer periphery of the wire, an amount of leakage can be set to be uniform over the entire perimeter of the rubber plug, so that the waterproofing function of the rubber plug can be enhanced.

It is preferable that the wire comprises a plurality of wires, and a plurality of guide grooves, to which the plurality of wires are individually fitted, are formed in parallel in each of the outer-surface-side half member and the inner-surface-side half member in such a manner as to widen toward base end portions thereof, the outer-surface-side half member and the inner-surface-side half member are pivotally connected to each other by a connecting portion provided at one end of the half members, a shaft center of the connecting portion is shifted radially outwardly or radially inwardly with respect to arcuate mating surfaces of the half members, the outer-surface-side half member and the inner-surface-side half member are engaged and disengaged while the arcuate mating surfaces are obliquely displaced with each other, and wherein displacement in a disengaging direction of the half members is regulated by causing inner surfaces of the guide grooves of both the half members to obliquely push outer-surfaces of the wires when an external force acting in a disengaging direction is exerted.

When the above structure is adopted, even when an external force acting in a disengaging direction is exerted on both the half members put in a united condition, the displacement in a disengaging direction of each of both the half members is regulated by causing the inner surfaces of the guide grooves of both the half members to obliquely push the outer surfaces of the wires. Thus, both the half members can tentatively be held in a united condition.

DETAILED DESCRIPTION OF PREFERRED EMBODIMENTS

Figure 1:
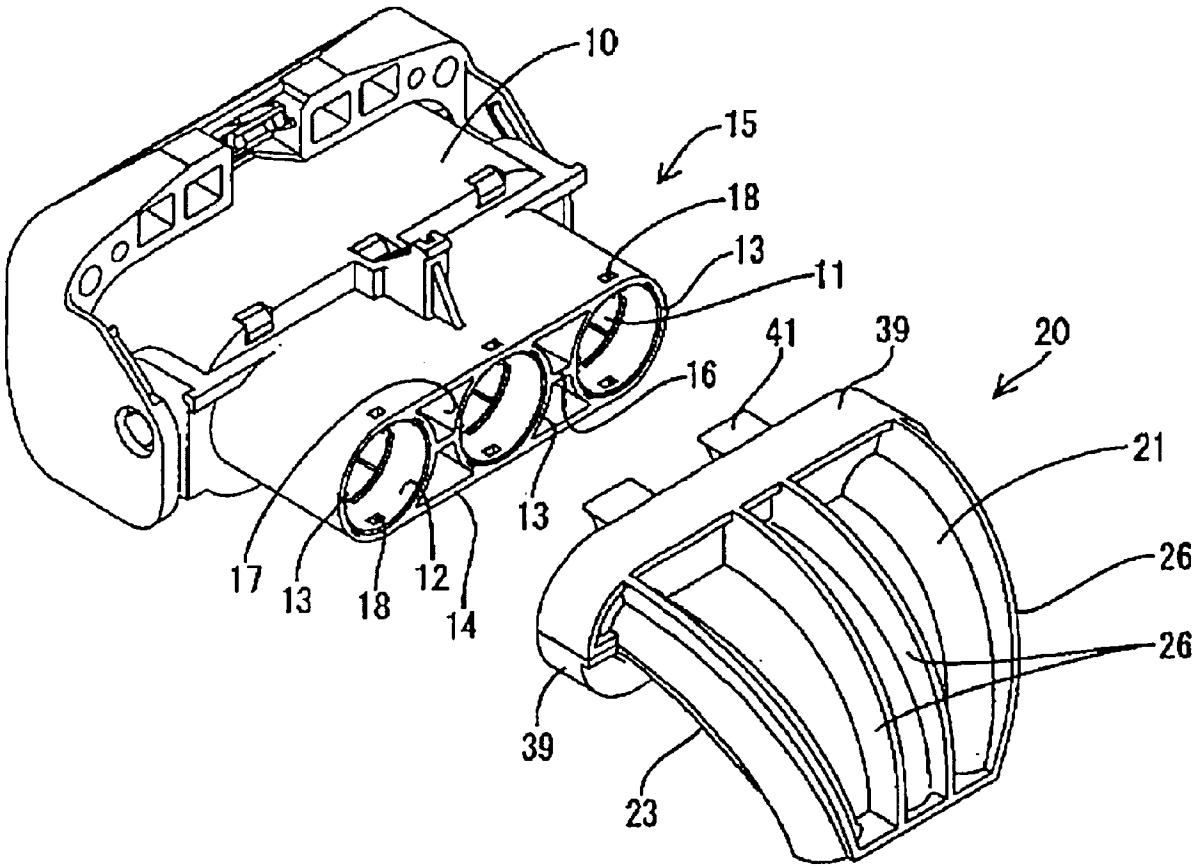
FIG. 1 is a perspective view illustrating a state in which a wire holder is removed from a housing in a first embodiment.
Figure 2:
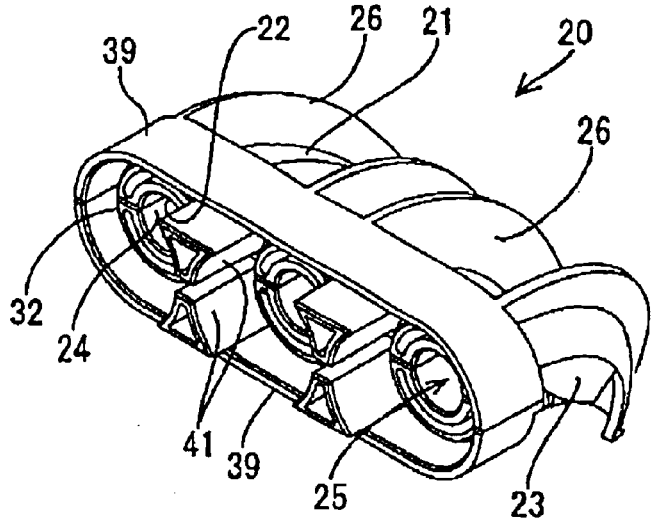
FIG. 2 is a perspective view illustrating the wire holder, which is taken from a base side thereof.
Figure 3:
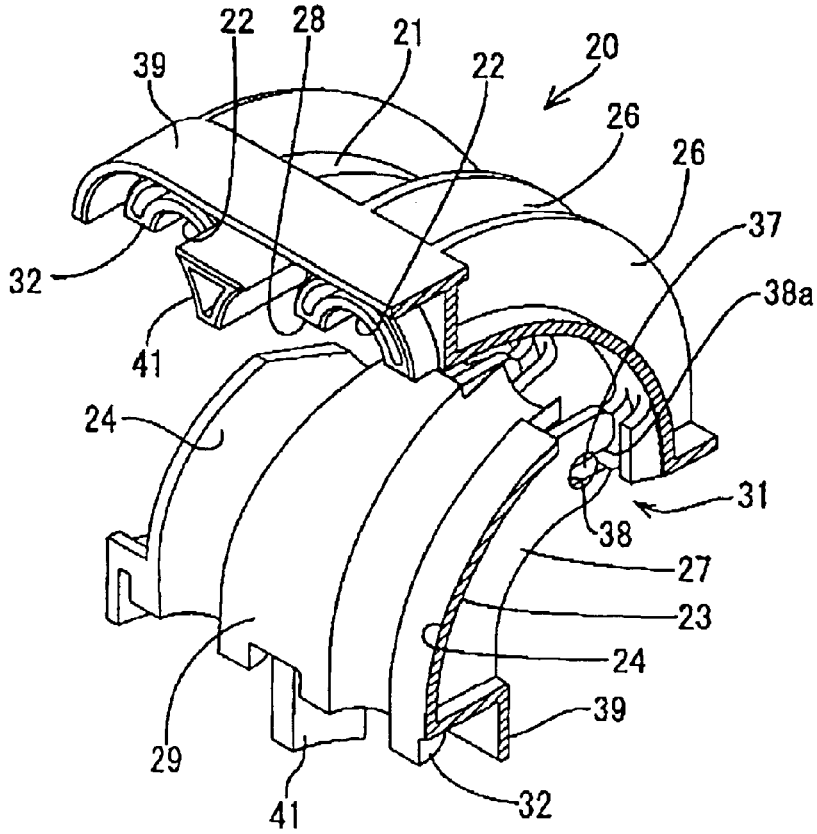
FIG. 3 is a partly cutaway perspective view illustrating a state in which both half members of the wire holder are disengaged from each other.

Referring to the drawings, embodiments of the present invention will be described below.

Hereinafter, an embodiment embodying the-invention is described with reference to FIGS. 1 to 7.

A connector according to this embodiment is configured by including a synthetic resin housing 10 and a synthetic resin wire holder 20. In the housing 10, three terminal accommodating portions 11 opened in the front and rear end surfaces thereof are formed in such a way as to be laterally arranged at a constant pitch. In each of the terminal accommodating portions 11, a terminal metal fitting (not shown) is inserted thereinto from the rear surface of the housing 10. An opening portion of the rear end side of each of the terminal accommodating portions 11 is opened in the rear surface of the housing 10 as a circular fitting hole 12. Further, each of the fitting holes 12 is constituted by a cylindrical peripheral wall 13. These three peripheral walls 13 are formed so that top ends of outer peripheral wall portions thereof are connected to one another by a flat connecting wall 14, and that the bottom ends of outer peripheral portions thereof are connected to one another by a flat connecting wall 14. An oblong elliptical fitting portion 15 is constituted by outer semicircular regions of the peripheral walls provided at the lateral sides thereof and both the top and bottom connecting walls 14. Furthermore, the peripheral walls 13 of each pair of the adjacent fitting holes 12 are connected to each other by connecting portions 16. A nearly trapezoidal receiving hole 17 is formed in the rear surface portion of the housing 10 in such a way as to include the connecting portions 16, the connecting walls 14 and the peripheral walls 13. Furthermore, paired top and bottom slip-off preventing holes 18 are provided on the inner periphery of each of the fitting holes 12 in such a manner as to communicate with the outer periphery of the fitting portion 15.

A wire holder 20 is used for holding the wire W in a state, in which the wire W is bent downwardly and arcuately by 90 degrees, by fitting the wire W backwardly led out from the rear surface of the housing 10 thereto. The wire holder 20 includes two members, that is, an outer-surface-side half member 21 and an inner-surface-side half member 23.

The outer-surface-side half member 21 is formed in such a way as to be shaped nearly like a quarter circular, when viewed sideways. Three guide grooves 22 each having a semicircular section are formed in the inner peripheral surface in such a manner as to be laterally arranged. These three guide grooves 22 are provided in parallel so that outer surface parts (outer semicircular regions of the outer periphery of the wire W) of a bent part of the wire W led out from the rear surface of the housing 10 are individually fitted to the guide grooves 22. So the wire W is intimately contacted with the guide grooves 22. Each of the guide grooves 22 widens in a direction from a leading end side (that is, the side directing downwardly and opposite to the rear surface of the housing 10) to a base end side (that is, the side directing frontwardly to the rear surface of the housing 10). Particularly, two guide grooves 22 respectively provided at both the left side and the right side are respectively constituted by paths formed laterally symmetrical with respect to the central guide groove 22 interposed therebetween. The lateral pitch between the guide grooves 22 gradually increases in the direction from the leading end to the base end of the holder.

The inner-surface-side half member 23 is formed in such a way as to be shaped nearly like a quarter circular, when viewed sideways. Three guide grooves 24 each having a semicircular section are formed in the inner peripheral surface in such a manner as to be laterally arranged. These three guide grooves 24 are provided in parallel so that outer surface parts (outer semicircular regions of the outer periphery of the wire W) of a bent part of the wire W led out from the rear surface of the housing 10 are individually fitted to the guide grooves 24 in such a way as to be in almost intimate contact therewith, and that each of the guide grooves 24 widens in a direction from a leading end side (that is, the side directing downwardly and opposite to the rear surface of the housing 10) to a base end side (that is, the side directing frontwardly to the rear surface of the housing 10. Particularly, two guide grooves 24 respectively provided at both the left side and the right side are respectively constituted by paths formed laterally symmetrical with respect to the central guide groove 24 interposed therebetween. The lateral pitch between the guide grooves 24 gradually increases in the direction from the leading end to the base end of the holder. The guide grooves 24 of such an inner-surface-side half member 23 respectively correspond to the guide grooves 22 of the outer-surface-side half members 21. When the half members 21 and 23 are put in a united condition, a holding hole 25, through which the wire W is passed without rattling motion, is constituted by the corresponding guide grooves 22 and 24.

Further, reinforcing ribs 26 are formed along the guide grooves 26 on outer peripheral surface (that is, an outer surface of an arcuate portion) of the outer-surface-side half member 21. Two ridges of reinforcing ribs 26 corresponding to the center guide groove 22 are formed, while a single ridge of a reinforcing rib 26 is formed correspondingly to each of the lateral guide grooves 22. Similarly, reinforcing ribs 27 are formed on the inner peripheral surface (that is, an inner surface of the arcuate portion) of the inner-surface-side 23 in such a way as to extend along the guide groove 24. Two ridges of reinforcing ribs 27 are formed correspondingly to the central guide groove 24. A single ridge of a reinforcing rib 27 is formed correspondingly to each of the lateral guide grooves 24.

The outer-surface-side half member 21 and the inner-surface-side half member 23 are united with each other in a state, in which the arcuate mating surfaces 28 and 29 are made to abut against each other, and in which a holding hole 25 is constituted by the guide grooves 22 and 24. Thus, the wire W can be held in a bent condition. This united condition (that is, a state in which the wire W is held in a bent condition) is held by a unification holder 30. The unification holder 30 is configured by including the fitting hole 12 provided in the rear surface portion of the housing 10 and the connecting portion 31 for connecting the outer-surface-side half member 21 and the inner-surface-side half member 23 to each other at the leading end portions in such a way as to be able to engage with and disengage from each other.

A fitting cylindrical portion 32 is formed at each of the base end portions of the outer-surface-side half member 21 and the inner-surface-side half member 23 in such a way as to have a semicylindrical form obtained by frontwardly extending a corresponding one of the end portions of the guide grooves 22 and 24, and as to have a cylindrical form obtained by bringing both the half members 21 and 23 into a united condition. When these three fitting cylindrical portions 32 are intimately inner-fitted to the fitting holes 12 of the housing 10, the base end portions of both the half members 21 and 23 are restrained from upwardly and downwardly disengaging. Further, paired upper and lower slip-off preventing pieces 33 are formed in each of the fitting cylindrical portion 32. During a state in which each of the fitting cylindrical portions 32 is inner-fitted into the corresponding one of the fitting holes 12, each of the slip-off preventing pieces 33 is engaged with the corresponding slip-off preventing hole 18, so that the wire holder 20 is prevented from rearwardly coming off the housing 10. Incidentally, these fitting holes 12 and the fitting cylindrical portions 32 serve as the unification holder 30 and also constitute fitting portions 35 for restraining the wire holder 20 from performing upward, downward, leftward and rightward rattling motions with respect to the housing 10.

The connecting portion 31 includes a nearly elliptical shaft portion 37 formed on a support portion 36, which is radially inwardly projected from the arcuate mating surface 28 at the leading end portion of the outer-surface-side half member 21, and also includes a circular bearing hole 38 formed in the reinforcing rib 27 at the inner-surface-side half member 23. A plurality of the shaft portions 37 and a plurality of the bearing holes 38 are arranged in a lateral direction in such a manner as to be apart from each other. A shaft center P corresponding to these elements is set in such a way as to be parallel to the direction in which the guide grooves 22 and 24 are arranged. Moreover, the shaft center P is positioned in such a way as to be positioned at a place, to which the center P is shifted inwardly radially with respect to the arcuate mating surfaces 28 and 29. Incidentally, this shaft center P is positioned at the place to which the center P is shifted inwardly and radially with respect to the guide groove 24 of the inner-surface-side half member 23. Furthermore, in a state in which the leading end portion of the outer-surface-side member 21 is downwardly directed, paired flat parts on the outer periphery of the nearly elliptical shaft portion 37 are directed to a horizontal direction. Further, a pilot hole 38*a* is formed in the reinforcing rib 27 of the inner-surface-side half member 23 so that the groove width thereof is equal to the distance between the flat parts of the shaft portion 37, and that the pilot groove 38*a* extends from the bearing hole 38 and reaches an outer edge of the reinforcing rib 27. In a state in which the leading end portion of the inner-surface-side half member 23 is downwardly directed (that is, in a state in which the inner-surface-side half member 23 is united with the outer-surface-side half member 21), the pilot groove 38*a* is downwardly opened. Moreover, in the state in which the leading end portion of the inner-surface-side member 23 is rearwardly directed (that is, the leading end portion of the inner-surface-side member 23 is downwardly opened 90° with respect to the outer-surface-side half member 21), the pilot groove 38*a* is backwardly opened so that the shaft portion 37 is enabled to be fitted into the pilot groove 38*a*.

Moreover, outer-fitting portions 39, each of which can be outer-fitted to a corresponding oval fitting portion 15 of the housing 10, is formed at the base end portions of the outer-surface-side half members 21 and the inner-surface-side half members 23. Each of the outer-fitting portions 39 and the fitting portion 15 are intimately fitted to each other and constitute a fitting portion 40 for regulating upward, downward, leftward and rightward rattling motions of the wire holder 20 with respect to the housing 10. Similarly, a nearly trapezoidal insertion portion 41 to be intimately inner-fitted to a receiving hole 17 provided in the rear surface portion of the housing 10 is formed at each of the base end portions of the outer-surface-side half members 21 and the inner-surface-side half members 23. Each of the insertion portions 41 and a corresponding one of the receiving holes 17 are intimately fitted to each other and constitute the fitting portion 35 for regulating upward, downward, leftward and rightward rattling motions of the wire holder 20 with respect to the housing 10, and also constitute the unification holder 30 for holding both the half members 21 and 23 in a united condition.

Furthermore, both the half members 21 and 23 put into the united condition are tentatively held in the united condition by a tentatively holding means even when the half members 21 and 23 are not fitted to the rear surface portion of the housing 10. The tentatively holding means includes sets 22 and 24 of three guide grooves formed in both the half members 21 and 23 in such a way as to be widen in a direction from the leading end portion side to the base end portion side (that is, in an upward direction, as viewed in FIG. 7) in parallel, as described above. And the tentatively holding means also includes connecting portion 31, the position of which is shifted radially and inwardly with respect to the arcuate mating surfaces 28 and 29 of both the half members 23 and 21. The connecting portion 31 has the shaft center P. Each of both the half members 21 and 23 is enabled by this connecting portion 31 to engage with and disengage from each other during performing relative displacement in an oblique direction with respect to the arcuate mating surface 29 or 28 of the counter-part one of the half members 23 and 21. When an external force acting in a disengaging direction is exerted on both the half members 21 and 23 brought into a united condition, the inner surfaces 22S of the guide grooves 22 provided at both left and right sides of the outer-surface-side half member 21 obliquely push the outer surface of the wire W from the base end side to the leading end side (that is, the downward direction in FIG. 7) as indicated by an arrow A shown in FIG. 7. Simultaneously, the inner surfaces 24S of the guide grooves 24 provided at both the left and right side of the half member 23 obliquely push the outer surface of the wire W in a direction (that is, a direction opposite to the direction in which the guide grooves 22 of the outer-surface-side member 21 is pushed) from the leading end side to the base end side (that is, the upward direction in FIG. 7) as indicated by an arrow B shown in FIG. 7. Thus, displacement in a disengaging direction, in which both the half members 21 and 23 are disengaged with each other, is regulated.

Next, an operation of this embodiment is described hereinbelow.

First, the terminal metallic fitting (not shown) securely fixed to the terminal of the wire W is inserted from the rear surface side into terminal accommodating portion 11 of the housing 10. Thus, the wire W is preliminary put into a state in which the wire W is backwardly led out from the fitting hole 12 provided in the rear surface of the housing 10. During in this state, the wire W is covered with the outer-surface-side half member 21 from above, and then the wire W is fitted to each of the guide grooves 22 by simultaneously and arcuately bending the wire W. At that time, even when a slight gap is provided between the wire W and the inner periphery of each of the guide grooves 22, it does not matter, as long as the wire W is in a state in which the wire W extends along the guide groove 22.

Figure 4:
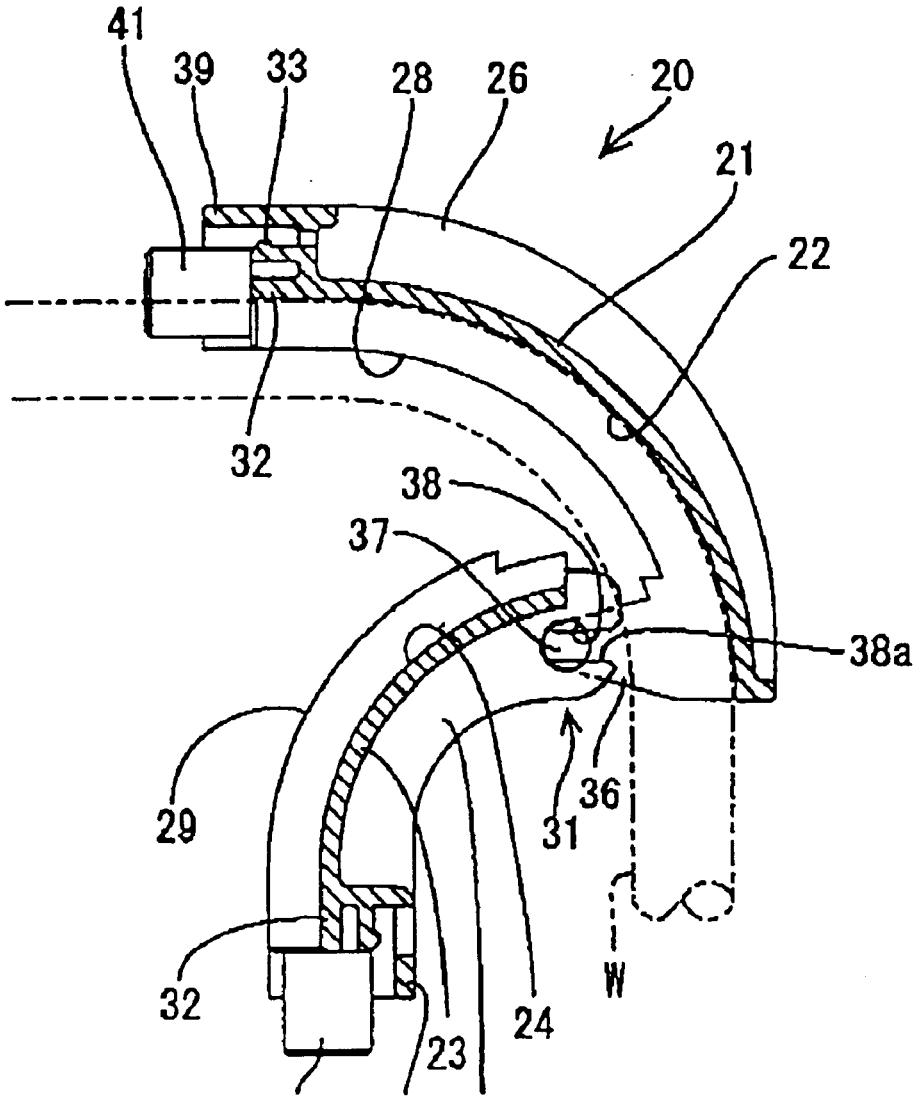
FIG. 4 is a sectional view illustrating a state in which both the half members are fully disengaged from each other.
Figure 5:
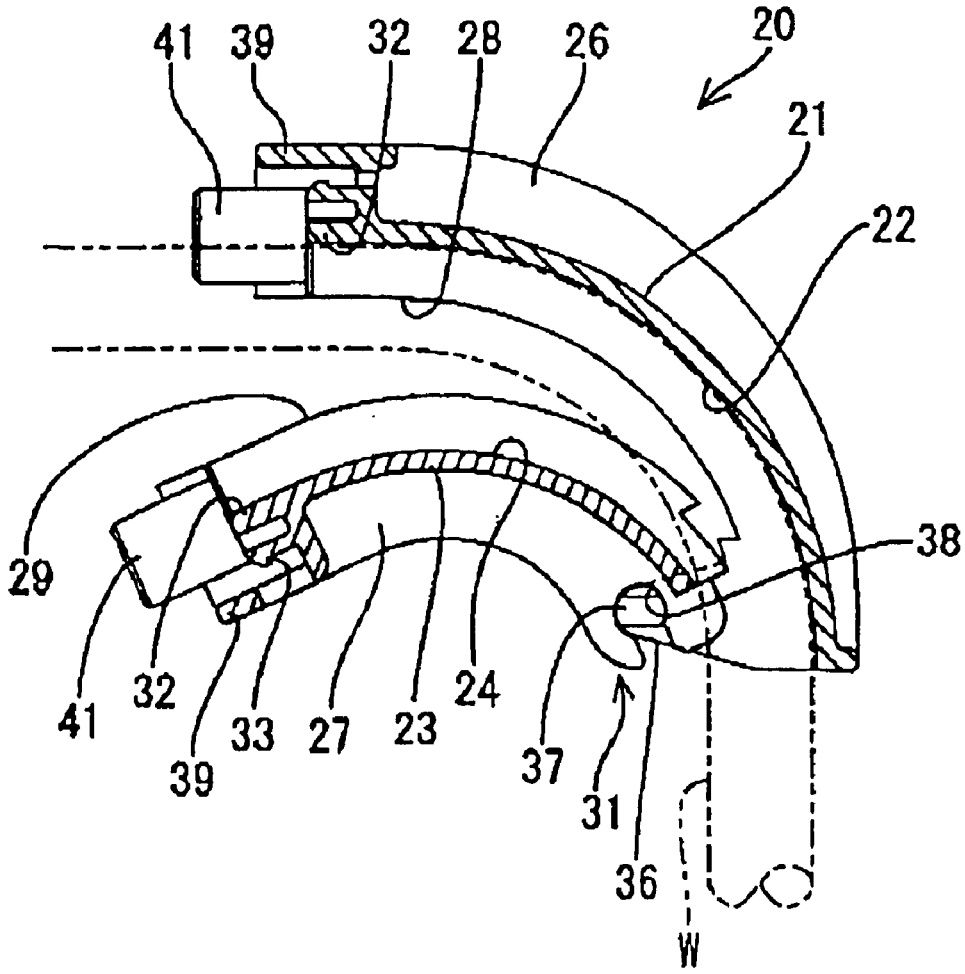
FIG. 5 is a sectional view illustrating a state in which both the half members are half disengaged from each other.
Figure 6:
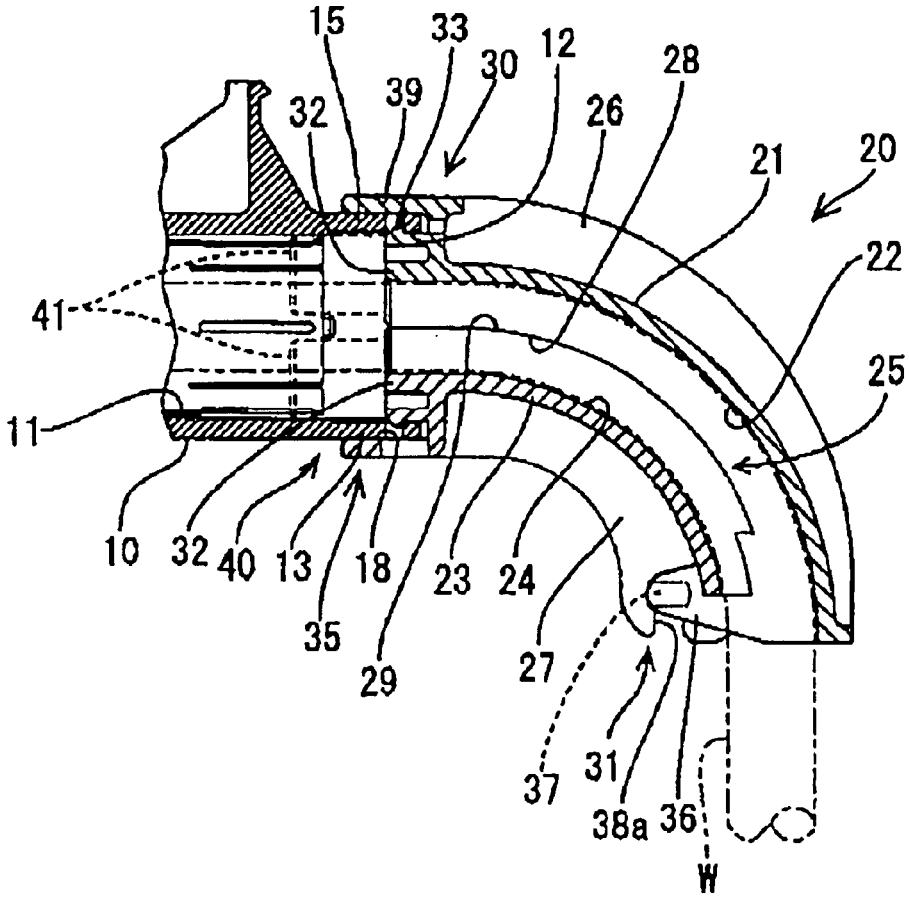
FIG. 6 is a partly sectional view illustrating a state in which the wire holder is fitted into the housing.
Figure 7:
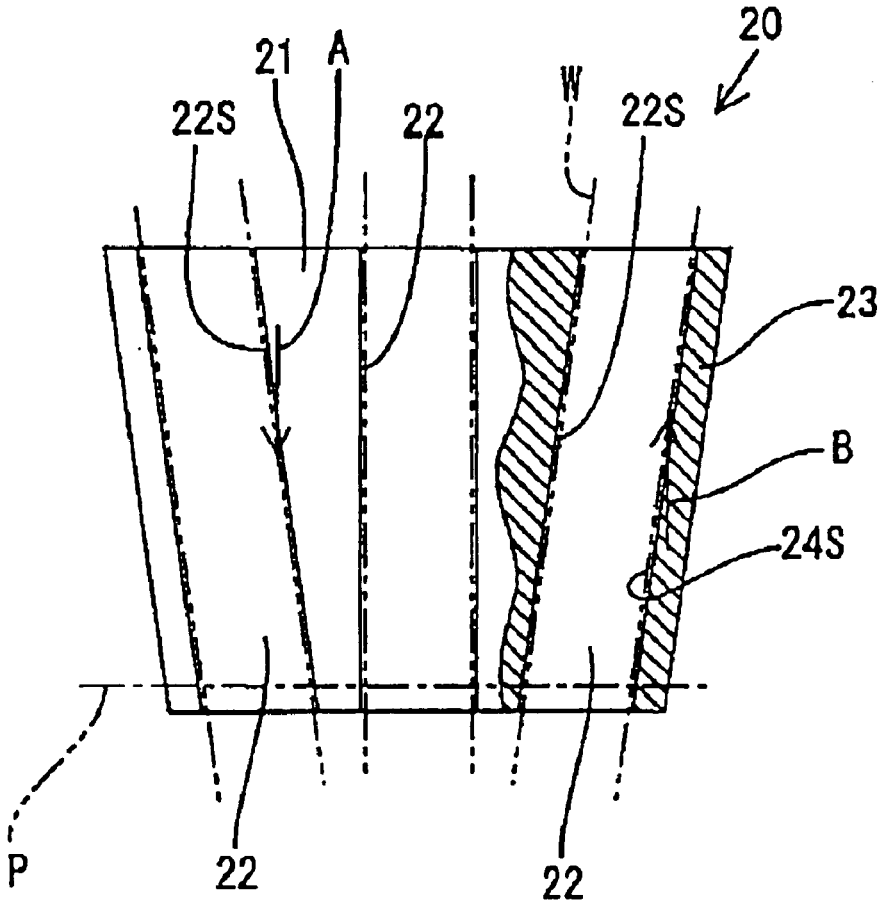
FIG. 7 is a conceptual view illustrating a mode of the half members, which has been united with each other and is pushed against the wire when an external force acts in a disengaging direction on both the wire holders that are in a joined state.

During this state, as illustrated in FIG. 4, the pilot groove 38*a* of the inner-surface-side half member 23 having a rear end portion backwardly is fitted to the shaft portion 37 of the outer-surface-side half member 21 from a frontward direction. Then, the shaft portion 37 is fitted into the bearing hole 38. Subsequently, the inner-surface-side half member 23 is upwardly rotation-displaced by using the shaft portion 37 and the bearing hole as the fulcrum in such a manner as to engage with the outer-surface-side half member 21. At that time, a turn center P is positioned at a place to which the center P is shifted inwardly with respect to the arcuate mating surfaces 28 and 29. Thus, the arcuate mating surface 29 of the inner-surface-side half member 23 approaches the arcuate mating surface 28 of the outer-surface-side half member 21 by simultaneously obliquely displacing with respect to the surface 28. Then, when the inner-surface-side half member 23 turns 90 degrees, both the arcuate mating surfaces 28 and 29 abut against each other, so that both the half members 21 and 23 are in a united condition. At the base end portions of both the half members 21 and 23, the fitting cylindrical portion 32 and the outer-fitting portion 39 are configured. Moreover, the wire W is fitted into the holding hole 25, which is constituted by the guide grooves 22 and 24 without radial move, and held in a state in which the wire W is arcuately bent.

During a state in which both the half members 21 and 22 are united with each other and hold the wire W, even when an external force acting in a disengaging direction (for example, a restoring force of the wire W itself) is exerted, the inner surfaces 22S and 24S of the guide grooves 22 and 24 obliquely push the outer surface of the wire S, so that both the half members 21 and 23 are restrained from displacing in the disengaging direction. Therefore, both the half members 21 and 23 are held in the united condition.

After both the half members 21 and 23 are united with each other in this way, the wire holder 20 is assembled to the rear surface of the housing 10 by being frontwardly slid while the wired W is slid in the holding hole 25 (that is, in the guide grooves 22 and 24). This assembly causes the fitting cylindrical portion 32 of the wire holder 20 to be intimately inner-fitted into the fitting hole 12 of the housing 10. Thus, the slip-off preventing piece 33 engages with the slip-off preventing hole 18. Then, the insertion portion 41 of the wire holder 20 is intimately inner-fitted to the receiving hole 17 of the housing 10. Moreover, the outer-fitting portion 39 of the wire holder 20 is intimately outer-fitted to the fitting portion 15 of the housing 10. Thus, the wire holder 20 puts the wire W into a state in which the wire W is arcuately bent.

During this state, the wire holder 20 is locked in a state in which the engagement between the slip-off preventing piece 33 and the slip-off preventing hole 18 restrains the wire holder 20 from coming off the housing 10. Further, both the half members 21 and 23 are connected to each other at the leading end portions thereof by engaging the shaft portion 37 with the bearing hole 38. Moreover, the fitting cylindrical portion 32 and the insertion portion 41 are inner-fitted into the fitting hole 12 and the receiving hole 17, respectively. Thus, both the half members 21 and 23 are restrained from being displaced in upward and downward disengaging directions (that is, in the direction in which the holding of the wire W is canceled). Furthermore, owing to the facts that the fitting cylindrical portion 32 and the insertion portion 41 are inner-fitted into the fitting hole 12 and the receiving hole 17, and that the outer-fitting portion 39 is outer-fitted to the fitting portion 15, the upward, downward, leftward and rightward tilting and rattling motions of the wire holder 20 are restrained. Thus, the wire W led out from the rear surface of the housing 10 is held by the wire holder 20 in a state in which the wire W is bent along the predetermined arcuate path. Further, the wire W is extended in a predetermined downward direction from the bottom end of the wire holder 20.

As described above, in the case of this embodiment, as the means for holding the wire W in a bent condition, both the outer surface and the inner surface of the bent portion of the wire W are fitted to the half members 21 and 23. Thus, even in the case that the wire W has a high restoring force when bend-deformed, the wire W can be held in a state in which the wire W is bent with predetermined curvature.

Further, the arcuate reinforcing ribs 26 and 27 are formed along the guide grooves 22 and 24 (that is, the path for holding the wire W) in both the half members 21 and 23. Thus, there is no fear that both the half members 21 and 23 are deformed in such a way as to change the curvature of the arcuate portion. Consequently, the wire can be reliably held so that the wire has a predetermined curvature.

Furthermore, when both the half members 21 and 23 are united with each other by simultaneously sandwiching the wires, both the half members 21 and 23 are engaged with each other by employing the shaft portion 37 and the bearing hole 38 as the fulcrums. Thus, even when the wire W is hard and difficult to bend, the wire W can be reliably held between both the half members 21 and 23 with a small force by leverage by being sandwiched therebetween.

Moreover, the fitting portion 35 restrains the wire holder 20 from performing a rattling motion with respect to the housing 10. Thus, the direction, in which the wire W is led out therefrom the rear surface of the housing 10, is held in a constant direction. Thus, for instance, in the case that a waterproof cylindrical rubber plug (not shown) is attached to between the inner periphery of the fitting hole 12 opened in the rear surface portion of the housing 10 and the outer periphery of the wire W, an amount of leakage can be set to be uniform over the entire perimeter of the rubber plug, so that the reliability of the waterproofing function of the rubber plug can be improved.

Further, when an external force acting in the disengaging direction is exerted on both the half members 21 and 23 put in the united condition, the inner surface 22S and 24S of the guide grooves 22 and 24 of both the half members 21 and 23 obliquely push the outer surface of the wire W, so that the displacement in the direction, in which both the half members 21 and 23 are disengaged from each other, is regulated. Thus, even when the wire holder 20 is not assembled to the housing 10, both the half members 21 and 23 can be temporarily held in the united condition.

The invention is not limited to the embodiment described in the foregoing description and the drawings. For example, the following embodiments are included in the technical scope of the invention. Moreover, various changes can be made without departing from the gist of the invention.

(1) Although a plurality of electric wires are held by a single wire holder in the aforementioned embodiment, the wires may be individually held by wire holders.

(2) Although the reinforcing ribs are formed on both the outer surface of the arcuate portion of the outer-surface-side half member and the inner surface of the arcuate portion of the inner-surface-side half member in the aforementioned embodiment, the reinforcing ribs may be formed on only one of the outer surface of the arcuate portion of the outer-surface-side half member and the inner surface of the arcuate portion of the inner-surface-side half member.

(3) Although the unification holder is constituted by the fitting hole of the housing and the pivotally supporting mechanism in the aforementioned embodiment, a ring-like member may be outer-fitted to both the half members as the means for holding both the half members in the united condition. Alternatively, a catching claw formed on one of the half members may be made to be caught in a catching hole formed in the other half member. Additionally, a ring-like member may be outer-fitted to both the half members and used for preventing both the half members from disengaging from each other.

(5) Although a plurality of guide grooves are arranged in parallel in such a way as to be widen toward the end thereof in the aforementioned embodiment, the guide groove may be formed in such a manner as to be placed in parallel to one another.

What is claimed is:

1. A connector comprising:

a housing, from a rear surface of which a wire is led out; and a wire holder to which the wire led out from the rear surface of the housing is fitted thereby to hold the wire in an arcuately bent state, wherein the wire holder includes:

an arcuate outer-surface-side half member to which only an outer surface of a bent part of the wire is fitted, including an arcuate surface that is contacted by the wire; and an arcuate inner-surface-side half member to which only an inner surface of a bent part of the wire is fitted, wherein the connector includes a unification holder for holding the outer-surface-side half member and the inner-surface side half member in a united condition, wherein fitting portions are integrally provided on the rear surface of the housing and a base end portion of the wire holder, the fitting portions are fitted to each other so as to regulate a rattling motion of the wire holder with respect to the housing.

2. The connector as claimed in claim 1, wherein an arcuate reinforcing rib is formed on at least once of an outer surface of an arcuate portion of the outer-surface-side half member and an inner surface of an arcuate portion of the inner-surface-side half member.

3. The connector as claimed in claim 1, wherein the unification holder includes:

a connecting portion for pivotally rotating and connecting the outer-surface-side half member and the inner-surface-side half member to each other at leading end portions thereof; and a fitting hole, provided in the rear surface of the housing, for regulating disengagement between the half members by inner-fitting base end portions of the half members.

4. The connector as claimed in claim 1, wherein the arcuate inner-surface-side half member includes an arcuate surface that is contacted by the wire.

5. A connector comprising:

a housing, from a rear surface of which a wire is led out; and a wire holder to which tie wire led out from the rear surface of the housing is fitted thereby to hold the wire in an arcuately bent state, wherein the wire holder includes:

an arcuate outer-surface-side half member to which an outer surface of a bent part of the wire is fitted; and an arcuate inner-surface-side half member to which an inner surface of a bent part of the wire is fitted, wherein the connector includes a unification holder for holding the outer-surface-side half member and the inner-surface-side half member in a united condition, wherein the wire comprises a plurality of wires, and a plurality of guide grooves, to which the plurality of wires are individually fitted, are formed in parallel in each of the outer-surface-side half member and the inner-surface-side half member in such a manner as to he widen toward base end portions thereof, the outer-surface-side half member and the inner-surface-side half member are pivotally connected to each other by a connecting portion provided at one end of the half members, a shaft center of the connecting portion is shifted radially outwardly or radially inwardly with respect to arcuate mating surfaces of the half members, the outer-surface-side half member and the inner-surface-side half member are engaged and disengaged while the arcuate mating surfaces are obliquely displaced with each other, and wherein displacement in a disengaging direction of the half members is regulated by causing inner surfaces of the guide grooves of both the half members to obliquely push outer-surfaces of the wires when an external force acting in a disengaging direction is exerted.

6. A connector comprising:

a housing, from a rear surface of which a wire is led out; and a wire holder to which the wire led out from the rear surface of the housing is fitted thereby to hold the wire in an arcuately bent state, wherein the wire holder includes:

an arcuate outer-surface-side half member to which only an outer surface of a bent part of the wire is fitted; and an arcuate inner-surface-side half member to which only inner surface of a bent part of the wire is fitted, wherein the connector includes a unification holder for holding the outer-surface-side half member and the inner-surface-side half member in a united condition, and wherein an arcuate reinforcing rib is formed on at least one of an outer surface of an arcuate portion of the outer-surface-side half member and an inner surface of an arcuate portion of the inner-surface-side half member.

7. A connector comprising:

a housing, from a rear surface of which a plurality of wires are led out, the housing holding the plurality of wires and aligning the plurality of wires in an alignment direction substantially perpendicular to a longitudinal axis or the plurality of wires; and a wire holder to which the plurality of wires led out from the rear surface of the housing are fitted thereby to hold the plurality of wires in a state of being arcuately bent about an axis substantially parallel to the alignment direction, wherein the wire holder includes:

an arcuate outer-surface-side half member to which only an outer surface of a bent part of the wire is fitted; and an arcuate inner-surface-side half member to which only an inner surface of a bent part of the wire is fitted, wherein the connector includes a unification holder for holding the outer-surface-side half member and the inner-surface-side half member in a united condition, wherein fitting portions are integrally provided on the rear surface of the housing and a base end portion of the wire holder, the fitting portions are fitted to each other so as to regulate a rattling motion of the wire holder with respect to the housing.

8. A connector comprising:

a housing, from a rear surface of which a wire is led out; and a wire holder to which the wire led out from the rear surface of the housing is fitted thereby to hold the wire in an arcuately bent state, wherein the wire holder includes:

an arcuate outer-surface-side half member to which only an outer surface of a bent part of the wire is fitted; and an arcuate inner-surface-side half member to which only an inner surface of a bent part of the wire is fitted, wherein the connector includes a unification holder for holding the outer-surface-side half member and the inner-surface-side half member in a united condition, wherein the unification holder includes:

a connecting portion that pivotally connects the outer-surface-side half member and the inner-surface-side half member to each other at leading end portions thereof, the connecting portion comprising a shaft portion on one of the half members and a hearing hole on the other of the half members, the shaft portion rotatably engaging the bearing hole; and a fitting hole, provided in the rear surface of the housing, for regulating disengagement between the half members by inner-fitting base end portions of the half members.

9. The connector as claimed in claim 8, wherein the hearing hole is circular, the shaft portion is substantially elliptical, and the connector further comprises a pilot groove leading to the bearing hole and sized such that the shaft portion can slide through the pilot groove in a first orientation, but cannot slide through the pilot groove in a second orientation that is different from the first orientation.

* * * * *